United States Patent [19]

Coleman et al.

[11] 4,301,106

[45] Nov. 17, 1981

[54] SPINNING PROCESS FOR NYLON 4 FIBER

[75] Inventors: Denis Coleman, Stamford, Conn.; Edwin J. Siegman, Pensacola, Fla.

[73] Assignee: American Cyanamid Company, Stamford, Conn.

[21] Appl. No.: 142,280

[22] Filed: Apr. 21, 1980

[51] Int. Cl.[3] ..... D01F 6/00

[52] U.S. Cl. ..... 264/205; 260/29.2 N; 264/211; 264/210.3

[58] Field of Search ..... 264/204, 211, 205, 210.3; 260/29.2 N

[56] References Cited

U.S. PATENT DOCUMENTS

| | | | |
|---|---|---|---|
| 3,076,774 | 2/1963 | Black et al. | 260/29.2 N |
| 3,324,061 | 6/1967 | Tanquary | 264/205 |
| 4,130,521 | 12/1978 | Katsumoto et al. | 264/176 F |
| 4,220,617 | 9/1980 | Pfeiffer et al. | 264/210.3 |

*Primary Examiner*—Jay H. Woo

*Attorney, Agent, or Firm*—Frank M. Van Riet

[57] ABSTRACT

A single phase fusion melt of nylon 4 and water when extruded through a spinneret to form a filament which is stretched provided a fiber of good physical properties without deterioration of the fiber-forming polymer.

3 Claims, No Drawings

SPINNING PROCESS FOR NYLON 4 FIBER

This invention relates to a melt-spinning process for fiber formed from nylon 4. More particularly, this invention relates to such a process wherein a homogeneous single phase fusion melt of nylon 4 is the fiber-forming composition.

Polypyrrolidone, nylon 4, is a highly desirable polymer for many uses. A particularly beneficial application would appear to be that of providing a textile fiber thereof which, because of the hydrophilic nature of nylon 4, would provide high moisture regain and desirable esthetic properties as a result.

Many efforts have previously been made to provide a melt-spun nylon 4 fiber. However, it was consistently found that when the polymer is heated to temperatures approaching its melting point, polymer decomposition occurs and the polymer essentially reverts to the monomer from which it was formed, pyrrolidone. This decomposition is readily evidenced by the sharp reduction in viscosity of the melt and the inability to process the resulting melt in fiber-making equipment.

Although it is potentially possible to provide nylon 4 fiber by wet and dry spinning procedures, the requirements for polymer solvent and recovery systems for the solvent to prevent environmental pollution and high solvent costs have not made such processes attractive. Furthermore, in the coagulation steps associated with the wet and dry spinning processes, it is not certain that the polymer will not undergo degradation or hydrolysis and result in inferior or useless product. Accordingly, what is necessary to encourage the promotion of nylon 4 fiber for textile purposes is a process for preparing such fiber which avoids the deficiencies associated with other fiber-forming processes therefor while still providing fiber of good physical properties. The provision for such a process would satisfy a long-felt need and constitute a significant advance in the art.

In accordance, with the present invention, there is provided a process for spinning a nylon 4 fiber which comprises preparing a homogeneous single phase fusion melt of polypyrrolidone and water at a temperature above the boiling point of water at atmospheric pressure and at a temperature and pressure which maintain water in liquid state, said temperature being below the deterioration temperature of said polypyrrolidone, extruding said melt through a spinneret to form a filament, and stretching said filament to provide molecular orientation.

The process carried out as described unexpectedly leads to fiber of desirable properties without significant loss in molecular weight of the fiber-forming polymer as a result of such processing. The nascent extrudate of the polymer-water composition surprisingly shows little tendency to uncontrollably release water when spun into the atmosphere. Consequently, the filaments obtained are essentially free of sheath-core structure, have little or no void structure, do not have a density gradient across the filament cross-section, do not develop striations upon stretching, and are essentially transparent.

In carrying out processing in accordance with the present invention, a polypyrrolidone of suitable molecular weight to serve as a fiber-forming polymer is employed. Such polymers and their methods of preparation are well-known in the art and do not have to be described further herein. Generally, polypyrrolidones of molecular weight of about 6,000 and greater are useful so long as they are capable of forming single phase fusion melts with water.

In preparing a homogeneous single phase fusion melt of a polypyrrolidone and water, the proper proportions of polymer and water must be employed. Usually the composition contains about 10 weight percent water and 90 weight percent polymer, but other proportions can be employed. The water content will be influenced by the temperature of operation, the molecular weight of the polymer, and other factors. A useful method for indicating the proper polymer-water composition is to construct a phase diagram. However, there is considerable latitude in the polymer-water composition, especially at higher temperatures of operation, and, as a result, homogeneous single phase fusion melts generally can exist at a range of water contents. It is generally preferred, however, to employ a water content of about 5–15 weight percent based on the total weight of polymer and water so that the tendency for rapid release of water from the nascent extrudate is minimized or prevented.

A convenient method for preparing the homogeneous single phase fusion melt is to premix the solid polymer with the desired amount of water so as to form a free-flowing, dry-appearing particulate which is then fed to a screw extruder which compresses and heats the composition to form a melt while developing at least autogeneous pressure. The temperature reached in the extruder should be sufficient to provide a homogeneous single phase melt but insufficient to cause significant polymer degradation or deterioration. Generally, a temperature in the range of about 160°–200° C. is suitable but it is generally preferred to operate at about 165°–175° C. Polypyrrolidone as a pure polymer melts at a temperature in the range of about 240°–260° C. accompanied by rapid depolymerization.

After the homogeneous single phase fusion melt is prepared, it is extruded through a fiber-forming spinneret to form filaments. The extrusion can be conducted by providing a spinneret at the outlet of the extruder and effecting extrusion with the pressure generated by the extruder. Alternatively, the useful melt can be extruded using alternative sources of pressure to generate the filaments. Conventional spinneret assemblies used in typical melt-spinning operations for fiber-making may be employed. Extrusion is preferably conducted in a manner in which the nascent filaments form in the atmosphere. Although it is possible to extrudate the filaments into other environments, it is not necessary to do so since good fiber properties are obtained without the need for special environments and this constitutes an unexpected development of the present process.

As the filamentary extrudate emerges from the spinneret into the atmosphere, there is little or no tendency for the rapid evaporation of water vapor from the filaments. Although the present inventors do not know why rapid evaporation of water is not evidenced and do not wish to be bound by any theory, it is their belief that the superior hydrophilicity of the nylon 4 polymer is responsible. Consequently, the filaments obtained have a homogeneous transparent structure substantially free of sheath-core structure, void-structure, density gradient across the filament cross-section, internal reflectance, and other deficiencies caused by uncontrolled release of water vapor from the nascent filaments.

As the filamentary extrudate emerges into the atmosphere from the spinneret orifices, it is subjected to stretching to provide molecular orientation of the fiber-forming polymer. Such stretching also reduces the denier of the filaments and can be conducted to a limited extent by conventional means, such as with draw down rolls and the like. To provide additional stretch, the filaments may be drawn in conjunction with heated air impinged thereupon. Alternatively or in conjunction therewith, the filaments may be drawn over a heated surface such as a plate, pin or roll. Such drawing may be down in one or more stages as the filaments are processed during spinning and, if desired, additional post-stretching procedures may be employed.

After the extruded filaments are stretched, processing in accordance with the present invention is complete although any desired additional processing steps may be conducted. As indicated, additional post-stretching may be conducted in accordance with conventional procedures. Such other process steps such as drying, relaxing, crimping, and the like may be performed singly or in combination in accordance with conventional procedures.

The invention is more fully illustrated in the examples which follow wherein all parts and percentages are by weight unless otherwise specified.

In the examples which follow, extrusion of the fiber-forming polymer composition was studied using an Instron capillary rheometer equipped with a single 100 micron diameter spinneret capillary and protective filter pack. Since the amount of nylon 4 available commercially is extremely limited, the amount of fiber that could be produced was insufficient to provide samples for more than cursory testing. It is known, however, from other studies involving numerous additional fiber-forming polymers that there is excellent correlation between performance on the Instron capillary rheometer and that was obtained using full-scale fiber-making equipment. In fact, when changes in polymer compositions are contemplated in full-scale commercial fiber-making processes, it is general procedure to evaluate the changed polymer composition using the Instron capillary rheometer to predict ultimate performance thereof. Accordingly, the results given in the examples, although qualitative in nature, are highly indicative of results obtained in full-scale operations and constitute practice of the present invention.

COMPARATIVE EXAMPLE

The polymer used in this example was a dry nylon 4 (polypyrrolidone). A sample of this polymer dissolved at 0.5% in formic acid exhibited a relative viscosity of 1.61. A portion of the dry polymer was placed in an Instron capillary rheometer equipped with a single 100 micron spinneret capillary. The polymer was heated at 240°-260° C. until a melt was formed. The melt obtained was a thin liquid consisting in the main of pyrrolidone monomer and upon extrusion of this thin melt a fiber could not be formed.

EXAMPLE

The same polymer described in the Comparative Example was employed. A mixture of 90 parts polymer and 10 parts water after blending was introduced into the Instron capillary rheometer described in the Comparative Example. After heating the polymer-water composition to a temperature of 170° C., a homogeneous single phase fusion melt formed. This melt was spun through the capillary into the atmosphere and formed a fiber. As the nascent filament formed, it was drawn away from the orifice by hand. Although it was not possible to measure the extent to which stretching was effected by this stretching technique, it appeared that adequate stretching was possible to provide good fiber properties. The fiber was essentially transparent in nature and appeared to have a homogeneous structure substantially free of voids, sheath-core structure, density gradient and surface striations. Hand tests indicated good tenacity both under straight and loop condition. A sample of the fiber was dissolved in formic acid to provide an 0.5% solution and the relative viscosity of the polymer thus obtained was 1.56 indicating that no significant reduction in molecular weight of the polymer resulted from the fiber-making process conducted.

We claim:

1. A process for spinning a nylon 4 fiber which comprises preparing a homogeneous single phase fusion melt of polypyrrolidone and water at a temperature above the boiling point of water at atmospheric pressure and at a temperature and pressure which maintain water in liquid state, said temperature being below the deterioration temperature of said polypyrrolidone, extruding said melt through a spinneret to form a filament, and stretching said filament to provide molecular orientation.

2. The process of claim 1 wherein said single phase fusion melt contains from about 5-15 weight percent water.

3. The process of claim 1 wherein said temperature is in the range of about 165°-175° C.

* * * * *